US005934676A

United States Patent [19]

Rubin

[11] Patent Number: 5,934,676

[45] **Date of Patent: *Aug. 10, 1999**

[54] CRAPS GAME TABLE HAVING EVENT SUMMARY DISPLAY

[76] Inventor: Bruce Rubin, 365 Pecan Dr., Deming, N.Mex. 88030

[ * ] Notice: This patent issued on a continued prosecution application filed under 37 CFR 1.53(d), and is subject to the twenty year patent term provisions of 35 U.S.C. 154(a)(2).

[21] Appl. No.: 08/686,600

[22] Filed: Jul. 26, 1996

[51] Int. Cl.[6] ..... A63F 9/24

[52] U.S. Cl. ..... 273/309; 463/16

[58] Field of Search ..... 273/309, 274, 273/138.2, 138.1, 246, 237; 463/22, 16; 364/412, 410

[56] References Cited

U.S. PATENT DOCUMENTS

| | | | |
|---|---|---|---|
| 5,487,547 | 1/1996 | Hobert | 273/274 |
| 5,490,670 | 2/1996 | Hobert | 273/309 X |
| 5,573,248 | 11/1996 | Parra et al. | 273/309 X |

*Primary Examiner*—Michael O'Neill

*Attorney, Agent, or Firm*—Paul Adams

[57] ABSTRACT

An electronically and physically improved craps game table designed to provoke and stimulate the interest of novice, occasional, and veteran craps game player is disclosed. The craps game table comprises: a dice rolling area; event registration means for registering a combination rolled; an electronic recent event display; and, a computer programmed to display historical and recent events. A preferred aspect of this invention provides for a craps game table as above wherein the computer is additionally programmed to summarize the most recent events, and wherein the computer is programmed to display the last nine events. The craps game table may additionally be marked to allow game players to wager on events sequentially occurring in two and more moves; and the computer may be programmed to display payoffs for those sequentially occurring events. The most preferred embodiment additionally provides for multiple individual bet placement layouts around the periphery of the table. The electronically improved craps game table provides for the possibility of heretobefore unavailable bet combinations; sequential bet possibilities which will attract game players with astronomical, ever changing and electronically posted payoffs; payoffs which will be exceptionally lucrative to the casinos.

18 Claims, 5 Drawing Sheets

A-A

CRAPS GAME TABLE HAVING EVENT SUMMARY DISPLAY

FIELD OF THE INVENTION

This invention relates to craps game tables and more particularly to such craps game tables which have electronic and electrical event summary displays as well as individual bet placement layouts.

BACKGROUND OF THE INVENTION

The gaming industry, sanctioned by increasing numbers of states, has experienced dynamic growth. Casinos, spurred by growing competition, are investing heavily in theme buildings and more elaborate equipment to compete for game players.

In the industry there is a desire to enhance the attractiveness of the game tables to the game players. What is appreciated by the more experienced game player is more information upon which to base their betting decisions and hunches. Such information, comparable to a race horse's track history, makes the game more interesting to intelligent better informed patrons. From the casino's viewpoint, such historical event information allows for the possibility of heretobefore unavailable bet combinations; bet combinations which will challenge and entice game players with enormous long shot and pool payoffs which will be exceptionally profitable to the casino.

OBJECTS AND STATEMENT OF THE INVENTION

It is an object of this invention to disclose innovations to the craps game table which will stimulate the interest of veteran game players. It is an object of this invention to summarize historical event information. It is an object of this invention to disclose a new dimension to a craps game table by presenting the possibility of new bet combinations for the game player to consider. It is a further object of this invention to disclose an innovation to the craps game table which promotes interest among game players, offers exciting payoffs, and concurrently is exceptionally lucrative for casinos. It is an object of this invention to allow game players to wager on events sequentially occurring in two and more moves. It is yet a further object of this invention to disclose a format for a craps game table which provides individual bet placement areas for each game player to facilitate identification of their bets.

One aspect of this invention provides for a craps game table comprising: a dice rolling area; event registration means for registering a combination rolled; an electronic recent event display; and, a computer programmed to display and summarize the most recent events.

A preferred aspect of this invention provides for a craps game table as above wherein the table is configured with individual bet placement layouts each adapted to allow the placement of bets on two or more sequential bets.

Various other objects, advantages and features of novelty which characterize this invention, are pointed out with particularity in the claims annexed to, and form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description make reference to the annexed drawings wherein.

Figure 1:
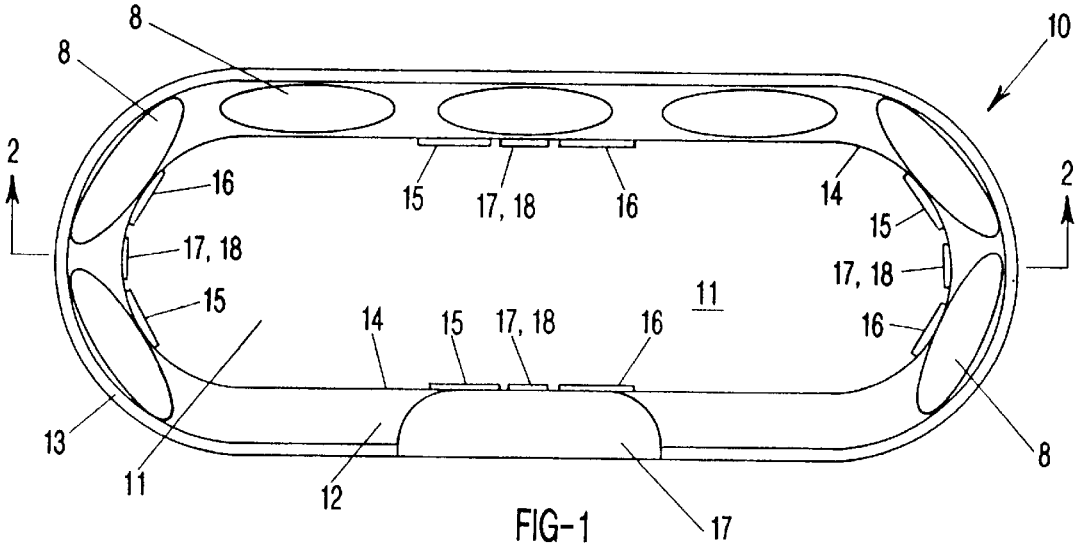
FIG. 1 is a plan view of a craps game table, having individual bet placement areas and an electronic event summary display.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a plan view of a craps game table 10, the subject of this invention. The craps game table 10 comprises a dice rolling area 11; event registration means (preferably a keyboard 19) for registering a combination rolled; an electronic recent event display 15,16,17,18; and, a computer (not shown) programmed to summarize and display the most recent events. A dice rolling area 10 forms the central part of the table 11. An upright wall 14, surrounding the dice rolling area 11, separates a peripheral portion of the table 10 therefrom. The peripheral portion of the table has individual bet placement layouts 8 on three sides therearound and a croupier's event summary 17, 18 and an event registration means therefor; preferably a condition event entry keyboard 19. A peripheral rail 13 extends around the most preferably oval shaped table 10.

Figure 2:
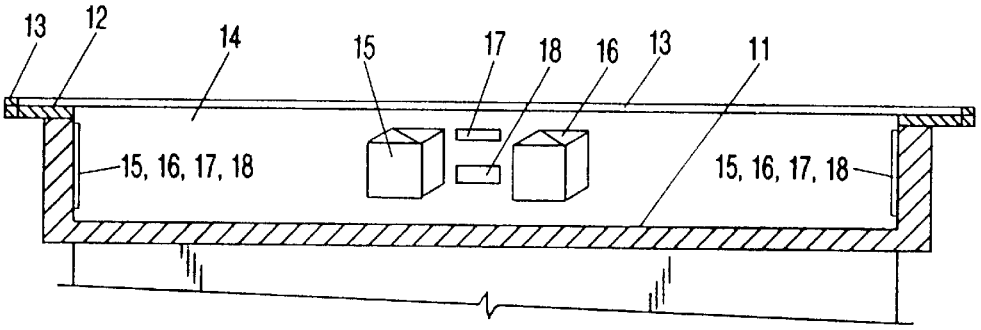
FIG. 2 is across sectional view of the craps table shown in FIG. 1 taken along line 2—2.

FIG. 2 is a cross sectional view of the craps table 10 shown in FIG. 1 taken along line 2—2. FIG. 2 best shows how the dice rolling area 11 and the upright sidewalls 14 together form a pit for throwing dice (not shown). Four electronic recent event displays 15,16,17,18 are positioned on the upright wall 14 at four locations around the table so that they may be viewed from the individual bet placement areas 8.

Figure 3:
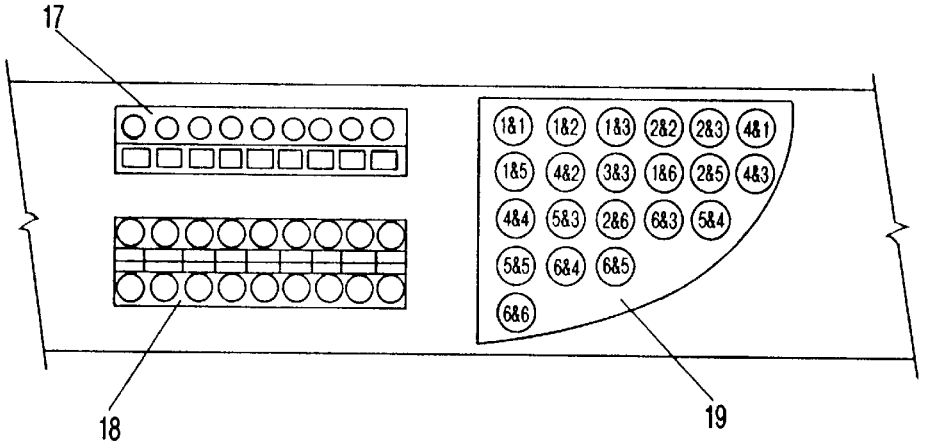
FIG. 3 is an enlarged broken away view of the croupier display and event entry portion of the craps table shown in FIG. 1.

FIG. 3 is an enlarged broken away view of the croupier display 17,18 and event entry portion 19 of the craps table 10. The event entry portion 19 comprises a keyboard 19 having a separate key for each possible dice combination which may be rolled. The keyboard 10 also includes a delete key to delete a combination entered in error. The keyboard 10 may be replaced by a computer aided scanning device for reading the top face of the dice after each roll and thereby, automatically identify and enter each dice combination defining an event.

Figure 4:
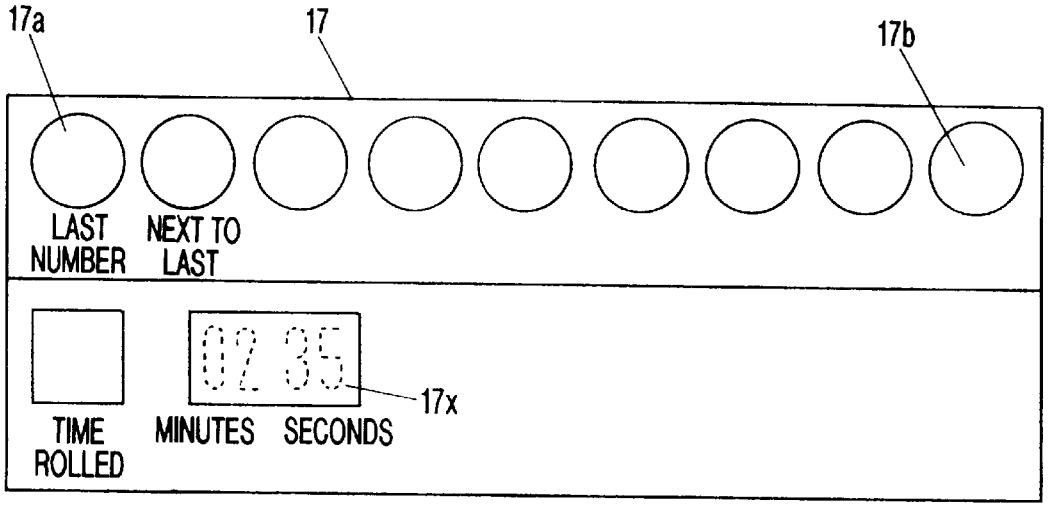
FIG. 4 is an enlarged view of a top portion of the croupier display shown in FIG. 3.

FIG. 4 is an enlarged view of a top portion 17 of the croupier display shown in FIG. 3. A similar type of display 17 is used on the interior sidewall 14 of the craps table 10 as shown in FIGS. 1 and 2. Top portion 17 comprises a row of nine—two digit displays, 17*a* through 17*i* each two digit display shows the total numerical value of a recent event. The 2 digit displays are chronologically arranged so that the last event is always displayed on the left display 17*a* and the ninth last event is displayed on the right display 17*i*. Intervening events are chronologically ordered therebetween. A lower portion of the display 17 comprises a digital display 17*x* recording the roll time of the last event.

Figure 5:
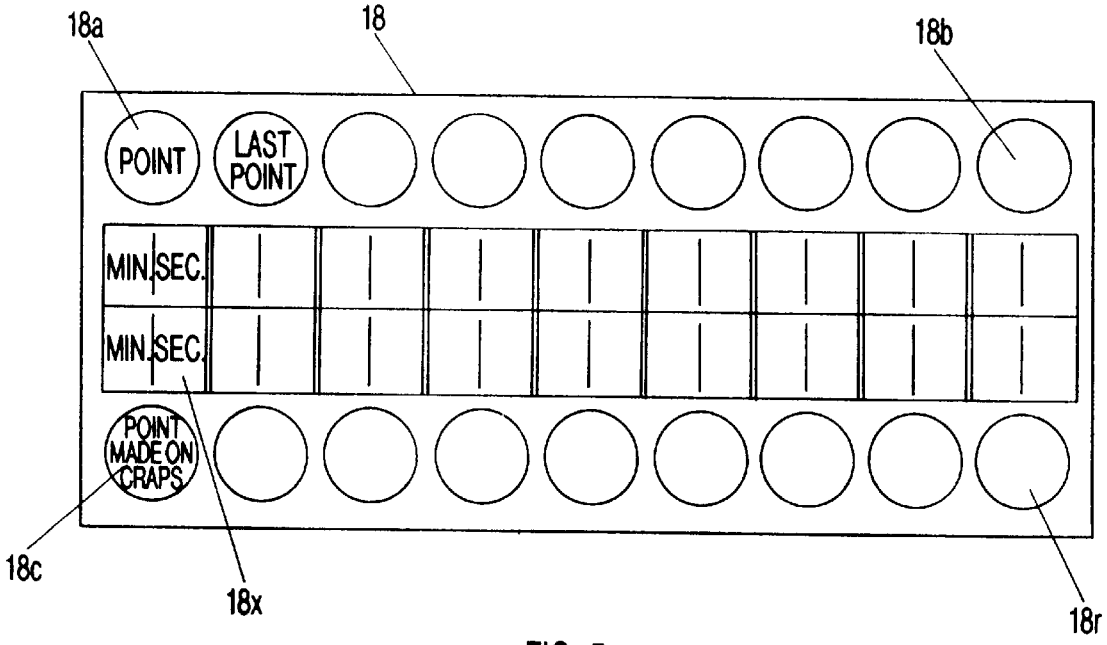
FIG. 5 is an enlarged view of a bottom portion of the croupier display shown in FIG. 3.

FIG. 5 is an enlarged view of a bottom portion 18 of the croupier display shown in FIG. 3. The top portion thereof comprises a row of nine—two digit event combination displays 18*a* through 18*i*, each two digit display shows the combination, e.g. 4+6 rolled on a recent event. These events are chronologically ordered so that the last combination appears on the left display 18*a* and the earliest appears on the most right display 18*a*. The lower section portion of the display 18 comprises a row of nine indicators. Each indicator 18*j* through 18*r* shows whether the come-out point (first roll of a turn) or craps was the outcome on one of the last nine events. As above these indicators 18*j* through 18*r* are chronologically ordered so that the last event appears on the left display 18*a* and the earliest appears on the most right indicator 18*i*. Between the top row of nine two displays 18*a* through 18*i* and the bottom row of nine indicators 18*j* through 18*r* there are eighteen identical digital time displays such as 18*x*. Each of these time displays indicates the time at which the adjacent event combination displays 18*a* through 18*i* or indicators 18*j* through 18*r* occurred.

Figure 6:
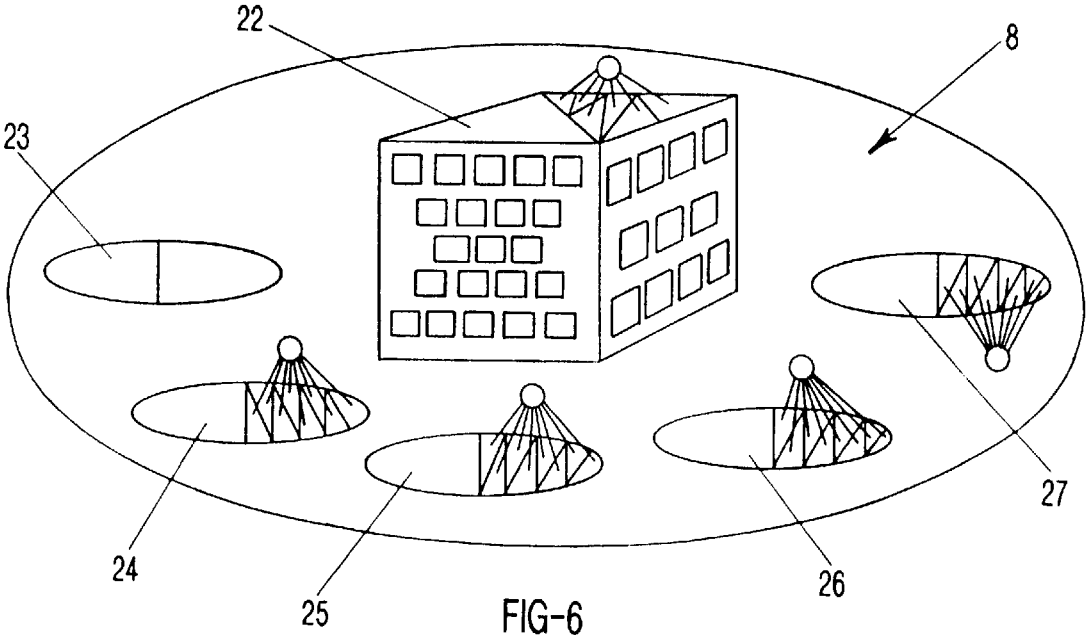
FIG. 6 is an enlarged view of an individual bet placement layout as shown on FIG. 1.

FIG. 6 is an enlarged view of an individual bet placement layout 8 shown on FIG. 1. The individual bet placement layout 8 comprises an electronic event display 22 (best seen enlarged on therefor FIG. 7 and a plurality of pressure sensitive bet placement areas 23, 24, 25, 26, and 27. Areas 23 through 27 include a come/don't come bet placement area 23 (best seen enlarged on FIG. 8); a don't pass bet placement area 24 (best seen enlarged on FIG. 9); a pass bet placement area 25 (best seen enlarged on FIG. 10); an odd bet placement area 26 (best seen enlarged on FIG. 11); and, an even bet placement area 27 (best seen enlarged on FIG. 12). A flag lamp 20 is positioned beside each individual bet placement area to alert the croupier when a bet is placed on one of the pressure sensitive bet placement areas 23, 24, 25, 26, or 27. Each of the bet placement areas 24, 25, 26, or 27 are electrically connected to a digital clock 28 (See FIG. 7) which will indicate the time at which the bet is placed on the bet placement area. A digital payout ratio display 21 is programmed to display the payoff, of an outcome based on events sequentially occurring over two or more moves, of the last touched bet placement area 23, 24, 25, 26, or 27.

Figure 7:
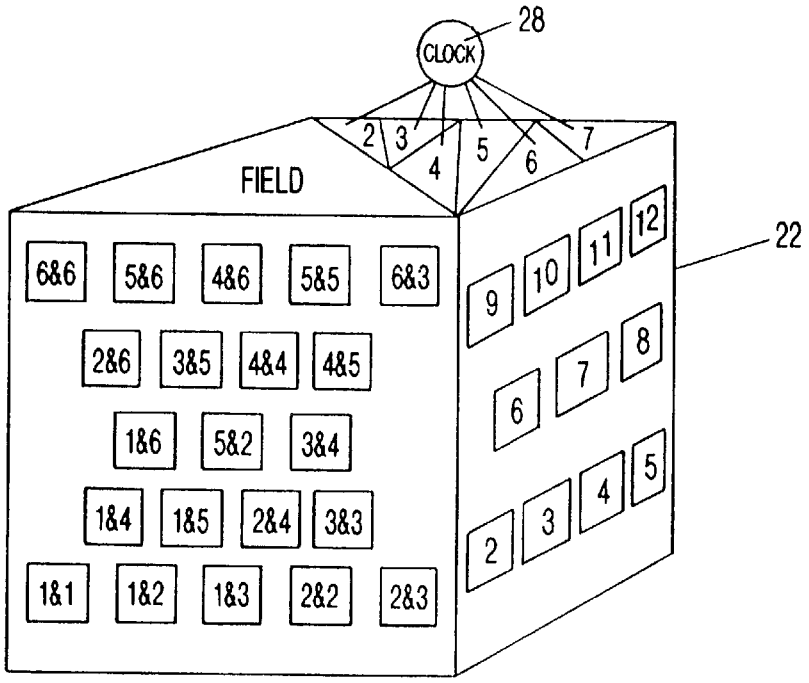
FIG. 7 is an enlarged view of an electronic event display as shown on FIG. 6.

FIG. 7 is an enlarged view of the electronic event display 22 shown on FIG. 6. This display 22 summaries the total number of times each two dice combination has been rolled after a time which appears on digital display 30.

Figure 8:
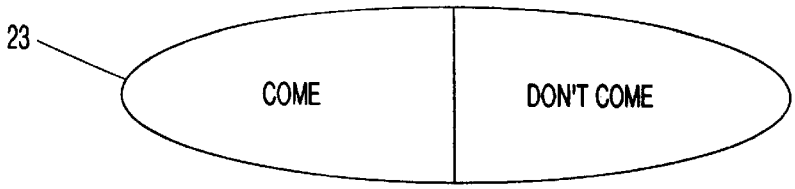
FIG. 8 is an enlarged view of a come/don't come bet placement area shown in the bet placement layout in FIG. 6.

FIG. 8 is an enlarged view of the come/don't come bet placement area 23 shown in the bet placement layout in FIG. 6. Flag lamp 20 shown thereon alerts the croupier when a bet is placed on the pressure sensitive bet placement layout 23. The bet placement layout 23 is marked to allow game players to wager on events sequentially occurring in two or more moves.

Figure 9:
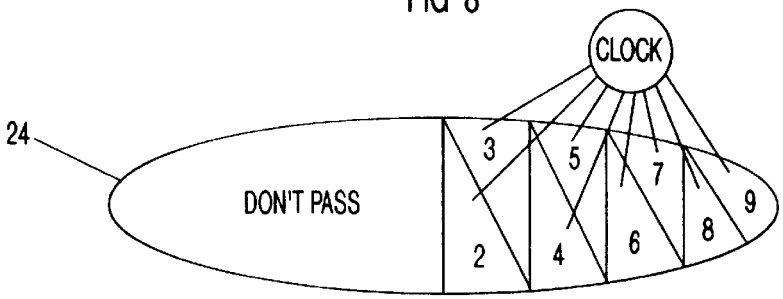
FIG. 9 is an enlarged view of a don't pass bet placement area shown in the bet placement layout in FIG. 6.

FIG. 9 is an enlarged view of the don't pass bet placement area 24 shown in the bet placement layout in FIG. 6. When a bet is placed on the pressure sensitive bet placement area 24 flag lamp 20 is turned on and clock 35 records the time at which the bet is placed. In the configuration shown the game player may bet on the outcome of up to nine sequential moves.

Figure 10:
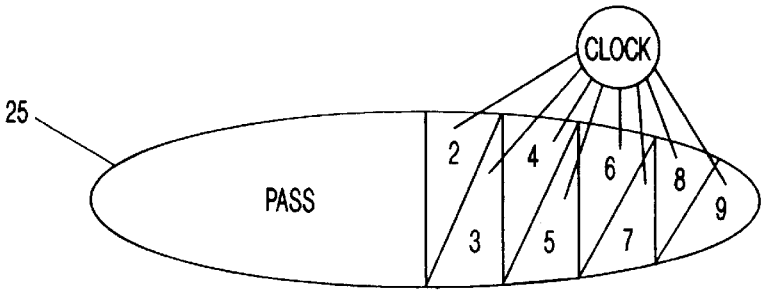
FIG. 10 is an enlarged view of a pass bet placement area shown in the bet placement layout in FIG. 6.

FIG. 10 is an enlarged view of the pass bet placement area 25 shown in the bet placement layout in FIG. 6. When a bet is placed on the pressure sensitive bet placement area 25 flag lamp 20 is turned on and clock 35 records the time at which the bet is placed. In the configuration shown the game player may bet on the outcome of up to nine sequential moves.

Figure 11:
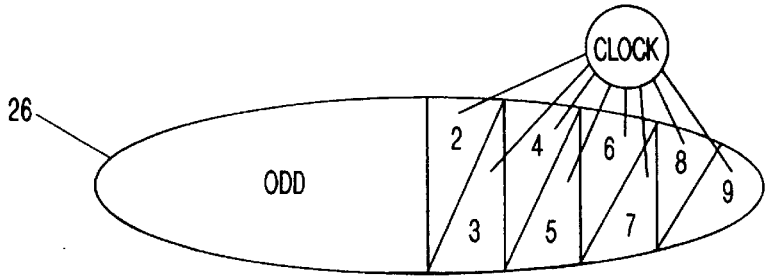
FIG. 11 is an enlarged view of an odd bet placement area shown in the bet placement layout in FIG. 6.

FIG. 11 is an enlarged view of the odd bet placement area 26 shown in the bet placement layout in FIG. 6.

Figure 12:
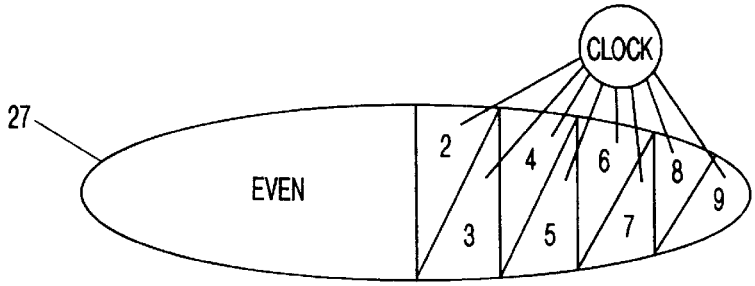
FIG. 12 is an enlarged view of an even bet placement area shown in the bet placement layout in FIG. 6.

FIG. 12 is an enlarged view of the even bet placement area 27 shown in the bet placement layout in FIG. 6.

Figure 13:
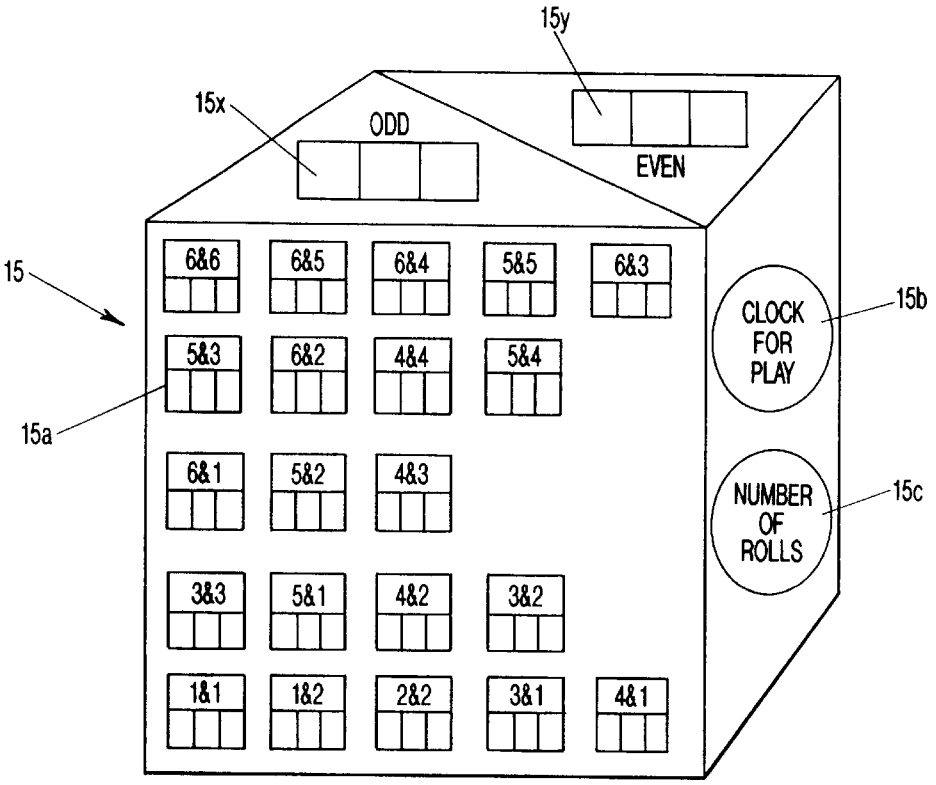
FIG. 13 is an enlarged view of the combination rolled - event summary display shown on the interior sidewall of the craps table in FIGS. 1 and 2.

FIG. 13 is an enlarged view of the combination rolled - event summary display shown on the interior sidewall 14 of the craps table 10 in FIGS. 1 and 2. Twenty-one three digit displays, one of which is designated 15*a*, record the number of times each dice combination has been rolled after a recorded time shown on clock 15*b*. Number of rolls indicator 15*c* records the number of rolls which have occurred after the recorded time on clock 15*b*. The number of odd rolls after the recorded time on the clock 15*b* is shown on display 15*x*. The number of even rolls after the recorded time on the clock 15*b* is shown on display 15*y*.

Figure 14:
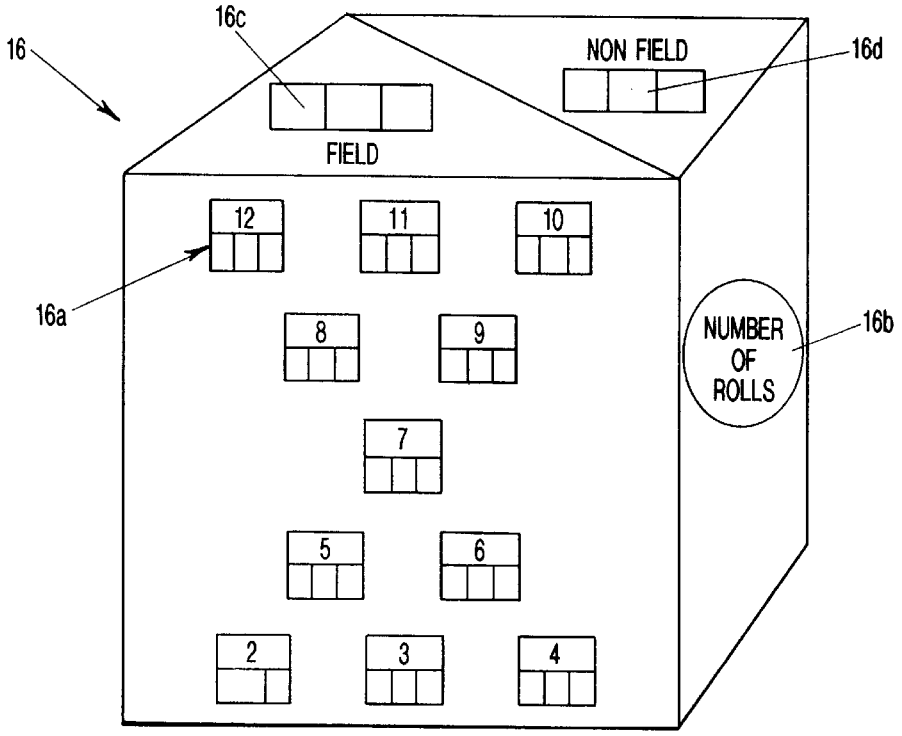
FIG. 14 is an enlarged view of the outcome total - event summary display shown on the interior sidewall of the craps table in FIGS. 1 and 2.

FIG. 14 is an enlarged view of the outcome total - event summary display 16 shown on the interior sidewall 14 of the craps table 10 in FIGS. 1 and 2. Eleven three digit displays, one of which is designated 16*a* record the number of times each two dice total has been rolled after a recorded time shown on clock 15*b*. Number of rolls indicator 16*b* records the number of rolls which have occurred after the recorded time on clock 15*b*. The number of field rolls after the recorded time on the clock 15*b* is shown on display 16*c*. The number of non-field rolls after the recorded time on the clock 15*b* is shown on display 16*d*. A field roll is generally one of the statistically less frequently rolled two dice totals such as 2, 3, 11, or 12. Some casinos define a field roll to include other less frequently occurring totals, in addition to the totals mentioned above.

In the course of play, the craps-type gaming device is used as follows. Referring first to the shared information on displays 15 and 16, as shown in FIGS. 13 and 14, the host of the gaming device sets the clock 15*b*. This is entirely an arbitrary time which may coincide with any event such as a croupier start of shift. That clock is suitable for recording time for a period of several or more hours. Commencing with the first roll of dice after the clock is initiated, the croupier then enters the dice-roll related information through the keyboard 19 or from similar manual or automatic means for sensing the numeric value of each die on each roll of the dice. That information is immediately recorded in the computer and is then displayed on displays 15 and 16. For example, if the first roll of the dice showed the numerical values 6 and 4, the croupier would press the 6+4 key on the keyboard and this information would be immediately displayed in the third display window (6+4) of the top row of display 15 in a color, highlighted by the croupier to differentiate it as the point and remaining highlighted until the point is made or craps is thrown, and different from the color used by displaying past recorded rolls. Since 6+4 is an even number, a one (1), indicating a single occurrence, would be displayed on the three digit Even display 15*y*. Of course, if the value were odd, the numerical value of Odd display 15*x* would be incremented. Simultaneously, the Number of Rolls display 15*c* would also be incremented and being correlated with the clock, would show the numerical value one (1) indicating that since play began, as recorded in clock 15*b*, there has been a single roll.

Simultaneously, since 6+4 equal 10, one of the three digit displays 16*a* would be incremented, namely, the display that indicates the number of occurrences of the numeral "10". The Number of Rolls display 16*b* would also be incremented. Assuming that the host has decided to offer betting on "field", the host would establish the values for Field such as the statistically less frequently rolled two dice total, 2, 3, 11 or 12. Of course, the casino may define a field roll to include other less frequently occurring totals including, for example, 4 and 10. Depending on how the host defines "field", and assuming that Field rolls comprise the above mentioned 2, 3, 11 or 12 values, then the roll in the example given above, namely 10, would be a "non-field" roll and would be recorded and displayed in Non-Field display 16*d*. Otherwise, it would be recorded and displayed in Field display 16*c*.

It will be understood that as the game continues, with each succeeding roll of the dice, and regardless of whether a player's turn has ended, that is, in a cumulative manner commencing at the time at which the clock was started, each roll of the dice will be recorded by the croupier and will increment the appropriate digital display 15*a*, 15*c*, 15*x*, 15*y*, 16*a*, 16*b*, 16*c*, and/or 16*d*.

Assume now that the game has been in progress so that the various displays indicate the cumulative occurrences of various dice-related information, and a player commences play at one of the stations 8. Referring now to FIGS. 6 through 12, play, as it relates to a single player, will be described. A player may place a bet by placing a chip on one of the pressure sensitive areas 23, 24, 25, 26 and/or 27. This placement records the time and type of the bet. Of course, area 23 is a common craps bet, namely, "Come"; a bet placed on Come wins if the first roll of a player's turn is 7 or 11 or if the player rolling the dice has made the Come Out point.

Referring to areas 24 and 25 of Station 8, it will be seen that a player may also make a "Don't Pass" or a "Pass" bet as in a standard craps game. But to create further complexity and therefore generate interest in players, areas 24 and 25 at each station also have in the right hand portion of the area (shown as an ellipse) pressure sensitive spots at that station for numerals 2 through 9. Rather than simply making a Don't Pass or Pass bet, the player may place a chip on, for example, the pressure sensitive spot with the numeral 3 on area 25. That represents a wager by the player that the player rolling the dice will pass three consecutive times. If that occurs, the player wins at appropriate odds; if not, the player loses. When the bet is placed on spot 3 of area 25, it trips an electronic switch that records the time and begins the running of a clock to indicate the time at which the bet was commenced which must precede any player's roll of the dice which is recorded by the croupier.

Continuing the description of the play, and using the same example as indicated above, and with attention drawn to FIGS. 4 and 5, dice-roll related information will be recorded and displayed on displays 17 and 18. Display 17 generally provides information regarding the last number rolled for each of the last 9 rolls. The most recent roll is shown in the left hand display 17*a* and the ninth last roll is displayed in display 17*b*. At the select ion of the host, this display may be reset at the beginning of each player's turn or may be cumulative since the initiation of clock 15*b*.

In display 18, as in display 15, the information generally provides dice-roll related information regarding the "Point" and whether or not that point has been "made" or craps has occurred prior to making the point. This is in accordance with standard craps rules.

By way of example, assuming the role of 6+4 has been completed and the croupier has electronically recorded that information through the keyboard 19. In display 17 the number then appearing in display 17*a* will immediately be transferred to the next right-adjacent display, and so on, until the number of the tenth previous roll is removed from display 17. Simultaneously, since this was the first roll of a player's turn, the value 10 constitutes the player's "Come Out Point" or simply, "Point" and this will be displayed in display 18*a* which is the left most display on display board 18. In the bottom row of displays on display board 18, display 18*c* will be blank until, on successive rolls of the player, the point 10 is either made or craps is thrown. Upon that occurrence, and of course the recording of that event by the croupier, display 18*c* will either display "Made" or "Craps". The timer in display board 17 indicates how current the displayed numbers have occurred. In other words, how long it has been since the last roll has occurred. In display board 18, one of the 18*x* time displays in the row closer to the top row of the displayed numbers will display the time at which the point was established. The time in the lower row corresponding to that same vertical column will show the time at which either that point was made or craps occurred.

As will now be understood, one of the important features of the craps-type gaming device of the present invention is the correlation between the occurrence of some dice-roll related information to a particular time. Thus, not only will a gambler have access to a history of various events, i.e., dice-roll related information, over some finite but extended period of time, information as to the occurrence of that particular event may also be obtainable, depending upon the particular event.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. In a craps-type gaming device including a table, having indicia defining permissible bets including Come, Don't Come, Pass, Odd, and Even bets, and where a player makes multiple dice throws the improvement comprising:

means for electronically recording dice-roll related and historical event timing information for past dice throws; and means for displaying dice-roll related information and event timing information in relation to one another.

2. The improvement of claim 1 wherein said electronic recording means includes means for relating the recorded time of an event with the recording of a corresponding dice-roll related event whereby the dice-roll related event that is recorded may be displayed relative to the time recorded.

3. The improvement of claim 1 wherein said means for electronically recording dice-roll related information and timing of events information comprises a keyboard operated by a croupier.

4. The improvement of claim 3 wherein said means for recording the dice-roll related information and the event timing information allows recording both a total of the dice roll and the numerical value of each of the two dice on such roll.

5. A craps-type gaming device comprising:

a table;

a vertical surrounding wall supported on the table inwardly of the table outer edge so as to define a surrounding ledge externally of the surrounding wall and a dice rolling area internally of the surrounding wall;

a plurality of player stations spaced at locations on said surrounding ledge, each of said stations having indicia defining a miniature craps table layout including Come, Don't Come, Pass, Odd, and Even areas, each of said areas being pressure sensitive so that placement of a chip on one or more of said areas triggers an electronic recording of such placement;

means for electronically recording dice-roll related information; and means for displaying dice-roll related information.

6. The craps-type gaming device of claim 5 wherein the ledge is raised above the floor supporting the table at a height convenient for seated players to observe and place bets on the player's station.

7. The craps-type gaming device of claim 5 wherein said electronic recording means includes recording the timing of an event.

8. The craps-type gaming device of claim 5 additionally including means for relating the recorded time of an event with the recording of a corresponding dice-roll related event whereby the dice-roll related information that is recorded is displayed relative to the time recorded and displayed.

9. The craps-type gaming device of claim 5 wherein said means for electronically recording dice-roll related information comprises a keyboard operated by a croupier.

10. The craps-type gaming device of claim 8 wherein said means for recording the dice-roll related information allows recording both a total of the dice roll and the numerical value of each of the two dice on such roll.

11. The craps-type gaming device of claim 10 wherein said means for displaying dice-roll related information comprises electronic two-digit displays for displaying the sum of a dice roll.

12. The craps-type gaming device of claim 10 wherein said means for displaying dice-roll related information additionally includes electronic two-digit displays, each digit representing the numerical value of one of the die of a dice roll.

13. The craps-type gaming device of claim 5 wherein said dice rolling area internally of the surrounding wall is free of any indicia.

14. A craps-type gaming device comprising:

a table;

a vertical surrounding wall supported on the table inwardly of the table outer edge so as to define a surrounding ledge externally of the surrounding wall and a dice rolling area internally of the surrounding wall, said area being entirely free of any indicia; and a plurality of player stations spaced at locations on said surrounding ledge, each of said stations having indicia defining a miniature craps table layout including Come, Don't Come, Pass, Odd, and Even areas, at least one of each of said areas being pressure sensitive so that placement of a chip on one or more of said areas triggers the electronic recording of such placement.

15. The craps-type gaming device of claim 14 wherein the electronic recording of the placement of a chip includes recording of the time of placement.

16. The craps-type gaming device of claim 15 additionally including means for manually electronically recording dice-roll related information.

17. The craps-type gaming device of claim 16 additionally including means for displaying dice-roll related information that has been electronically recorded.

18. The craps-type gaming device of claim 14 wherein said surrounding ledge is raised above the floor supporting the table at a height convenient for seated players to observe and place bets on the player's station.

* * * * *